US010968921B2

(12) United States Patent
Cho et al.

(10) Patent No.: US 10,968,921 B2
(45) Date of Patent: Apr. 6, 2021

(54) BLOWER FAN

(71) Applicant: LG ELECTRONICS INC., Seoul (KR)

(72) Inventors: Namjoon Cho, Seoul (KR); Dongkeun Yang, Seoul (KR); Hyoungsuk Woo, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 287 days.

(21) Appl. No.: 15/260,659

(22) Filed: Sep. 9, 2016

(65) Prior Publication Data

US 2017/0067486 A1 Mar. 9, 2017

(30) Foreign Application Priority Data

Sep. 9, 2015 (KR) ..... 10-2015-0127822

(51) Int. Cl.

| | |
|---|---|
| ***F04D 29/66*** | (2006.01) |
| ***F04D 29/32*** | (2006.01) |
| ***F04D 29/38*** | (2006.01) |
| ***F04D 29/28*** | (2006.01) |
| ***F04D 29/02*** | (2006.01) |

(52) U.S. Cl.

CPC ..... *F04D 29/662* (2013.01); *F04D 29/023* (2013.01); *F04D 29/281* (2013.01); *F04D 29/328* (2013.01); *F04D 29/329* (2013.01); *F04D 29/388* (2013.01)

(58) Field of Classification Search

CPC .... F04D 29/662; F04D 29/663; F04D 29/664; F04D 29/666; F04D 29/667; F04D 29/668; F04D 29/18; F04D 29/242

USPC ..... 416/144

See application file for complete search history.

(56) References Cited

U.S. PATENT DOCUMENTS

| | | | | |
|---|---|---|---|---|
| 8,182,220 | B2 * | 5/2012 | Li | F04D 25/0613 415/220 |
| 2002/0182053 | A1 * | 12/2002 | Miyazawa | F04D 29/282 415/77 |
| 2009/0191055 | A1 | 7/2009 | Li et al. | |
| 2010/0215505 | A1 * | 8/2010 | Takeshita | F04D 25/0613 416/223 R |

FOREIGN PATENT DOCUMENTS

| | | | |
|---|---|---|---|
| JP | 09-112487 | A | 5/1997 |
| KR | 20-1998-0023091 | U | 7/1998 |

* cited by examiner

*Primary Examiner* — Kenneth Bomberg
*Assistant Examiner* — Jason Mikus
(74) *Attorney, Agent, or Firm* — Dentons US LLP

(57) ABSTRACT

A blower fan for preventing noise generated from blades and a peripheral interference object is provided, the blower fan including a cylindrical hub, a plurality of blades disposed to be spaced apart an asymmetric distance from one another about the hub, and a balancer connected to the hub to balance the blades.

4 Claims, 2 Drawing Sheets

BLOWER FAN

CROSS-REFERENCE TO RELATED APPLICATION

The application claims priority under 35 U.S.C. § 119 to Korean Patent Application No. 10-2015-0127822, filed Sep. 9, 2015, whose entire disclosure is hereby incorporated by reference.

BACKGROUND

1. Field of the Invention

A blower fan, more particularly to, a blower fan preventing noise generated between blades and a peripheral interference object.

2. Description of the Related Art

A blower fan is generally used to force air via a rotational force of an impeller or a rotor. The blower fan is typically applied to, for example, a refrigerator, an air conditioner, a vacuum cleaner, etc. The blower fan is typically classified as an axial flow fan, a sirocco fan, or a centrifugal fan according to air intake and discharge methods, or according to shape.

Conventional blower fans are problematic in that they have a latent blade passage frequency (BPF) such that noise is generated between blades and peripheral interference objects (e. g. a fan grill, orifice, etc.).

SUMMARY OF THE INVENTION

The present invention is provided in view of the above problems. A first object of the present invention is to provide a blower fan that prevents noise generated between blades and a peripheral interference object.

In accordance with an embodiment of the invention, the above and other objects can be accomplished by the provision of a blower fan that includes a cylindrical hub, a plurality of blades disposed to be spaced apart an asymmetric distance from one another about the hub, and a balancer connected to the hub to balance the blades.

BRIEF DESCRIPTION OF THE DRAWINGS

The accompanying drawings, which are included to provide a further understanding of the invention and are incorporated in and constitute a part of this application, illustrate embodiments of the invention and together with the description serve to explain the principle of the invention. In the drawings.

DETAILED DESCRIPTION OF THE PREFERRED EMBODIMENTS

Advantages, features, and methods for achieving those of embodiments may become apparent upon referring to embodiments described later in detail together with attached drawings. However, embodiments of the invention are not limited to the embodiments disclosed hereinafter. The embodiments are provided to complete disclosure of the invention and to fully provide a person having ordinary skill in the art to which the invention pertains. The same reference numbers may refer to the same elements throughout the specification.

Hereinafter, a blower fan according to an embodiment of the invention will be described with reference to the accompanying drawings.

Figure 1:
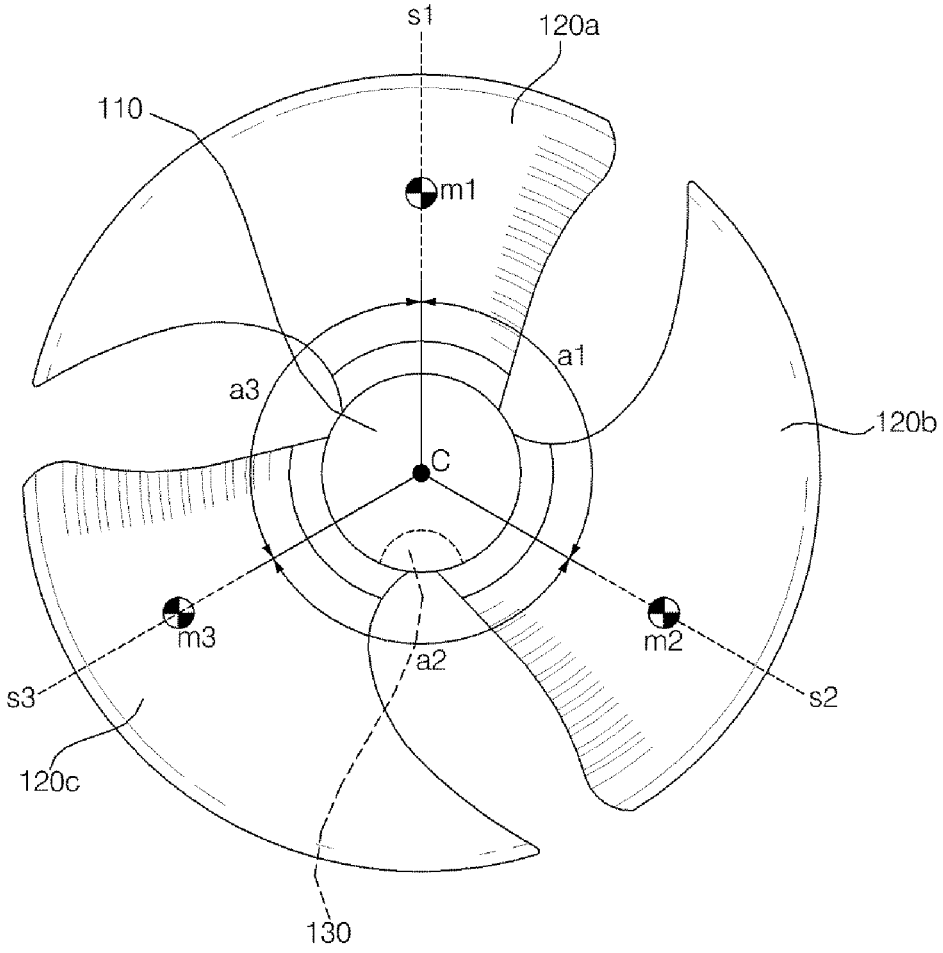
FIG. 1 is a plan view illustrating a blower fan according to an embodiment of the present disclosure.
Figure 2:
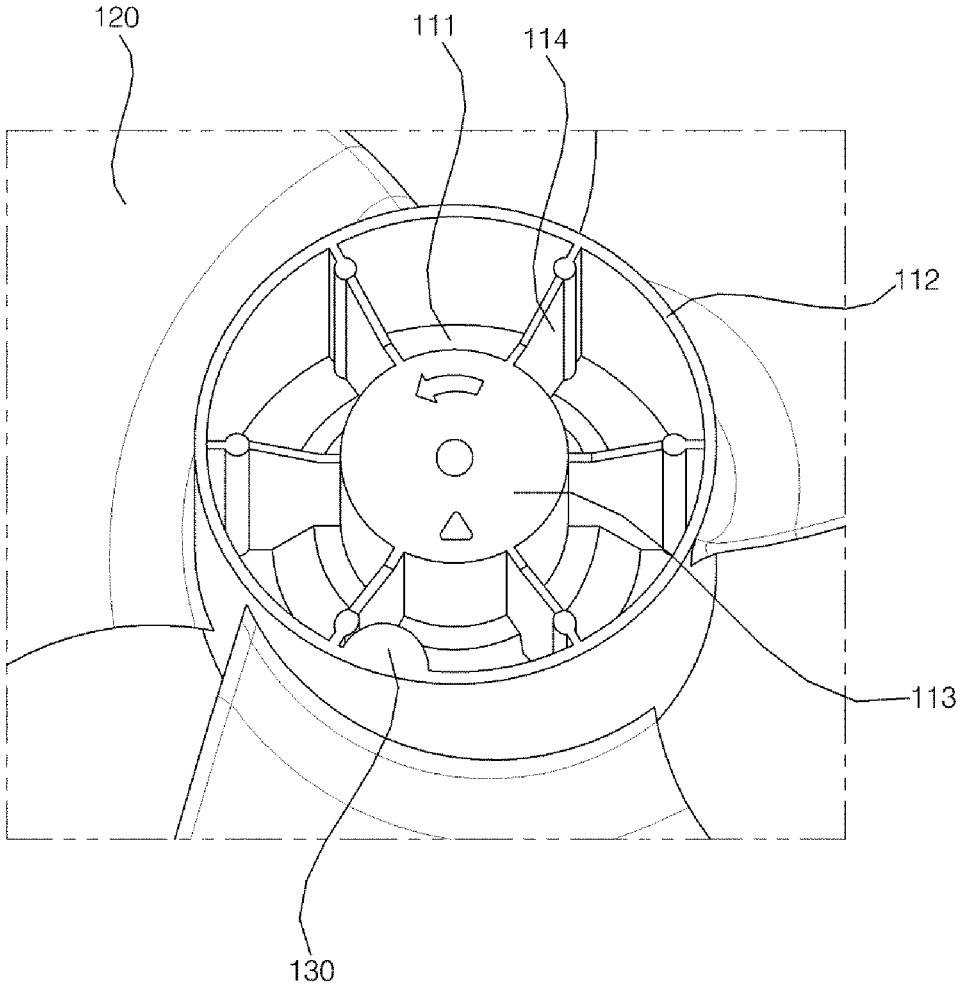
FIG. 2 is a partial perspective view illustrating the blower fan according to the illustrated embodiment of the present disclosure.

FIG. 1 is a plan view illustrating a blower fan according to an embodiment of the invention. FIG. 2 is a partially perspective view illustrating the blower fan according to the illustrated embodiment of the invention.

As shown, the blower fan may include a cylindrical hub 110, a plurality of blades 120 that are spaced apart an asymmetric distance from one another about the hub 110, a balancer 130 coupled to the hub 110 to be balanced with the blades 120.

The hub 110 may be formed in a cylindrical shape, but is not limited thereto. An axis (e. g., a motor shaft) for rotating the blower fan may be coupled to a rotational axis C of the hub 110. The blades 120 may be coupled to a circumference of the hub 110 and spaced apart an asymmetric distance from one another.

As shown, the hub 110 may include a main plate 111 having a circular plate shape, a cylindrical circumferential surface 112 surrounding a circumference of the main plate 111 to be connected to the blades 120, a hub axis 113 disposed in the circumferential surface 112 and spaced from the circumferential surface 112 while one side of the hub axis 113 is connected to a central part of the main plate 111 to couple the axis for rotating the blower fan to the rotational axis C, and a plurality of ribs 114 radially disposed and connected between the hub axis 113 and the circumferential surface 112.

According to an embodiment of the invention, each of the blades 120 functions as a wing for blowing air. Each of the blades 120 may be formed to have an airfoil type. A plurality of the blades 120 may include at least two blades 120. In the illustrated embodiment, for example, the blades 120 include a first blade 120*a*, a second blade 120*b*, and a third blade 120*c*. The blades 120 preferably each have the same shape.

Each of the blades 120 has a center of mass m. As shown in FIG. 1, for example, the first blade 120*a* has a first center of mass m1, the second blade 120*b* has a second center of mass m2, and the third blade 120*c* has a third center of mass m3.

The blades 120 may be connected to the circumferential surface 112 of the hub 110 and spaced apart an asymmetric distance from one another. As shown, given a plurality of reference lines s (e.g., s1, s2, and s3) each from the center of mass m (e.g., m1, m2, and m3) to the rotational axis C of the hub 100, the blades 120 may be disposed such that at least two of a plurality of included angles a (e.g., a1, a2, and a3) between the adjacent reference lines s (e.g., s1, s2, and s3) are different from each other.

In the illustrated embodiment, for example, given a first reference line s1 from the first center of mass m1 to the rotational axis C of the hub, a second reference line s2 from the second center of mass m2 to the rotational axis C of the hub, and a third reference line s3 from the third center of mass m3 to the rotational axis C of the hub, at least two of a first included angle a1 between the first reference line s1 and the second reference line s2, a second included angle a2 between the second reference line s2 and the third reference line s3, and a third included angle a3 between the first reference line s1 and the third reference line s3 may be different from each other. In the illustrated embodiment, the first included angle a1 is 120 degrees, the second included angle a2 is 130 degrees, and the third included angle a3 is 110 degrees. It is understood that the angles a1, a2, and a3 are not limited to the illustrated degrees.

The balancer 130 may be connected to the hub 110 to balance the blades 120. However, because the blades 120 are spaced apart an asymmetrical distance from one another, during rotation of the blower fan, imbalance may occur. Thus, the balancer 130 is disposed to balance the blades 120 in order to prevent generation of imbalance. The balancer 130 may be disposed at a side between the blades which have the largest included angle among the included angles. For example, as shown in FIGS. 1 and 2, the balancer 130 is disposed at the side between the blades which have the second included angle a2, namely, between the second blade 120*b* and the third blade 120*c*.

The balancer 130 is preferably disposed such that a center of mass of the entire blower fan is positioned at the rotational axis C of the hub 110. For example, the balancer 130 may be disposed such that the sum of a plurality of centripetal force vectors generated from the center of mass of each blade 120 to the rotational axis C and a plurality of centripetal force vectors generated from the center of mass (not shown) of the balancer 130 to the rotational axis C is zero when the blower fan is rotated.

The balancer 130 may protrude from an inner surface of the circumferential surface 112 of the hub 110 toward the rotational axis C of the hub 110. The balancer 130 may be molded with the hub 110 in an integrated manner. For example, the balancer 130 may be formed to have a half cylindrical shape in consideration of molding of the blower fan. In this case, a rectangular surface of the balancer 130 may be connected to the inner surface of the circumferential surface 112 of the hub 110.

The balancer 130 may be disposed at the inner surface of the circumferential surface 112, between two ribs 114 among a plurality of ribs 114 to prevent interference with the ribs 114. The blades 120 may be disposed according to positions of the ribs 114 such that the balancer 130 is disposed to prevent interference with the ribs 114.

As is apparent from the above description, a blower fan in accordance with embodiments of the invention has at least the following effects.

One, the blades are spaced apart an asymmetric distance from one another, thereby minimizing noise due to blade passage frequency (BPF).

Two, the balancer prevents imbalance generated due to disposition of the blades which are spaced apart an asymmetric distance from one another.

Although the preferred embodiments of the invention have been disclosed for illustrative purposes, those skilled in the art will appreciate that various modifications, additions and substitutions are possible, without departing from the scope and spirit of the invention as disclosed in the accompanying claims.

What is claimed is:

1. A blower fan comprising:

a hub;

a plurality of blades spaced apart an asymmetric distance from one another about the hub; and a balancer connected to the hub to balance the blades, wherein the hub comprises, a circular main plate, a circumferential surface surrounding a circumference of the main plate to be connected to the blades, a hub axis disposed in the circumferential surface, one end of the hub axis connected to a central part of the main plate, and a plurality of ribs radially disposed to be connected to the circumferential surface, wherein the balancer has a half cylindrical shape, protrudes from an inner surface of the circumferential surface to a rotational axis (C) of the hub, and is disposed between two ribs among a plurality of ribs, the balancer being integrally molded with the hub, wherein the balancer is disposed such that a center of mass of the blower fan is positioned at a rotational axis (C) of the hub, and wherein the plurality of blades is disposed such that the balancer does not interfere with the plurality of ribs, wherein the plurality of blades are disposed such that at least two adjacent included angles, among a plurality of included angles each of which is an angle between reference lines from respective centers of mass of the plurality of blades toward a rotational axis (C) of the hub, are different from each other, wherein the balancer is disposed at a side of the hub between the plurality of blades which have the largest included angle among the plurality of included angles, wherein the plurality of blades comprise only three blades, the three blades including a first blade having a first center of mass, a second blade having a second center of mass, and a third blade having a third center of mass, wherein the balancer is disposed such that a sum of a plurality of centripetal force vectors generated from the center of mass of each blade to the rotational axis (C) and a plurality of centripetal force vectors generated from the center of mass of the balancer to the rotational axis (C) is zero when the blower fan is rotated, wherein the first blade, the second blade, and the third blade are each connected to the hub and spaced apart an asymmetric distance from one another, wherein there is a first reference line from the first center of mass to a rotational axis (C) of the hub, a second reference line from the second center of mass to the rotational axis (C) of the hub, and a third reference line from the third center of mass to the rotational axis (C) of the hub, wherein at least two of a first included angle a1 between the first reference line and the second reference line, a second included angle between the second reference line and the third reference line, and a third included angle between the first reference line and the third reference line are different from each other, wherein the balancer is disposed such that a center of mass of the blower fan is positioned at the rotational axis (C) of the hub, wherein the first included angle is 120 degrees, the second included angle is 130 degrees, and the third included angle is 110 degrees, and wherein the balancer is disposed between the second blade and the third blade.

2. The blower fan of claim 1, wherein the balancer is disposed between the plurality of blades which have the largest included angle among the first, second, and third included angles.

3. The blower fan of claim 1, wherein the balancer is integrally formed with the circumferential surface.

4. The blower fan of claim 3, wherein the ribs are connected to the hub axis.

* * * * *